US010188937B1

(12) United States Patent
Whitney

(10) Patent No.: US 10,188,937 B1
(45) Date of Patent: Jan. 29, 2019

(54) PUZZLE BOOK

(71) Applicant: Brady Whitney, Maquoketa, IA (US)

(72) Inventor: Brady Whitney, Maquoketa, IA (US)

( * ) Notice: Subject to any disclaimer, the term of this patent is extended or adjusted under 35 U.S.C. 154(b) by 0 days.

(21) Appl. No.: 15/620,815

(22) Filed: Jun. 12, 2017

Related U.S. Application Data

(60) Provisional application No. 62/348,140, filed on Jun. 10, 2016.

(51) Int. Cl.
*A63F 9/08* (2006.01)
*A63F 9/06* (2006.01)
*A63F 9/00* (2006.01)

(52) U.S. Cl.
CPC ..... *A63F 9/08* (2013.01); *A63F 9/0078* (2013.01); *A63F 9/0602* (2013.01); *A63F 9/0807* (2013.01); *A63F 9/0819* (2013.01)

(58) Field of Classification Search
CPC ..... A63F 9/08; A63F 9/0819; A63F 9/0807; A63F 9/0602; A63F 9/0078; E05B 37/20
USPC ..... 273/157 R, 156, 155, 153 S, 153 R; 434/332; 446/147–151, 487, 281, 283; 70/289, 290
See application file for complete search history.

(56) References Cited

U.S. PATENT DOCUMENTS 517,729 A * 4/1894 Cable ..... E05B 37/12 70/304
555,829 A * 3/1896 Rogers ..... B65D 63/1018 190/27
1,054,716 A * 3/1913 Sand ..... B65D 50/045 206/1.5
1,254,538 A * 1/1918 Rice ..... B65D 50/045 206/1.5
1,490,295 A * 4/1924 Stephens ..... A63H 33/38 206/459.1
2,271,204 A * 1/1942 Peters ..... E05B 37/02 70/3
2,848,823 A * 8/1958 Washburn ..... G09B 17/00 273/155
2,917,325 A * 12/1959 Sines ..... A63H 33/38 273/141 R
2,959,872 A * 11/1960 Rodgers ..... G09B 17/00 40/495

(Continued)

*Primary Examiner* — Steven B Wong
(74) *Attorney, Agent, or Firm* — Clyde R. Christofferson, Esq.

(57) ABSTRACT

A linked sequence of mechanically encoded puzzle pages is disclosed. Each page is comprised of multiple planar layers interconnected to implement the puzzle design of the page. The puzzle of each page must be solved to disengage a latching mechanism enabling the player to turn the page and begin solving the puzzle in the next page. Similarly for the next page, and each succeeding page until the last page, solution to the puzzle by the player will disengage a latching mechanism. The latching mechanism holds the active page being solved by the player to the next page. In the implementation of the invention described in this disclosure the latching mechanism comprises a hooking piece protruding in a perpendicular direction from the planar front surface of the next page, where the hooking piece fits into an opening on the planar back surface of the active page and a blocking piece on the active page is aligned between the hook portion and the exit to the opening, thereby preventing the hooking piece on the next page from disengaging from the active page.

3 Claims, 18 Drawing Sheets

(56) References Cited

U.S. PATENT DOCUMENTS 3,758,693 A * 9/1973 Ebert ..... A63H 33/38 273/443
3,815,920 A * 6/1974 Carter ..... A63F 9/10 273/157 R
4,453,743 A * 6/1984 Sanders ..... B42D 3/10 281/18
4,640,512 A * 2/1987 Burke ..... A63F 9/001 273/157 R
5,213,507 A * 5/1993 Ozrovitz ..... A63F 9/10 273/157 R
5,615,883 A * 4/1997 Stevens ..... A63F 9/1044 273/157 R
5,653,471 A * 8/1997 Koehn ..... A63F 9/1011 281/15.1
5,683,112 A * 11/1997 McQueeny ..... A63F 9/1044 281/15.1
5,954,518 A * 9/1999 Teichberg ..... B42D 1/00 281/29
5,988,684 A * 11/1999 Blaustein ..... G09F 19/08 281/15.1
6,095,818 A * 8/2000 Brazley ..... A63F 9/0811 434/173
6,098,325 A * 8/2000 Goldman ..... G09F 11/23 281/15.1
6,132,216 A * 10/2000 Muntean ..... G09B 19/02 281/42
6,402,523 B1 * 6/2002 Kaufman ..... G09B 1/00 281/15.1
6,821,182 B2 * 11/2004 Polick ..... G09B 1/00 281/15.1
D515,625 S * 2/2006 Loo ..... D19/26
7,192,628 B2 * 3/2007 Burrows ..... A63H 33/26 235/449
2003/0085563 A1 * 5/2003 Polick ..... B42D 1/00 281/15.1
2004/0253567 A1 * 12/2004 Kaye ..... G09B 5/062 434/178
2007/0085269 A1 * 4/2007 Martin, Jr. ..... A63F 9/10 273/157 R
2014/0120799 A1 * 5/2014 Lam ..... G09B 1/06 446/147

* cited by examiner

PUZZLE BOOK

This patent application claims priority from U.S. Provisional Application 62/348,140 for "Codex Silenda: The Book of Puzzles" filed on Jun. 10, 2016, which is incorporated herein by reference.

BACKGROUND OF THE INVENTION

Field of the Invention

The present invention generally relates to games, and in particular to mechanically encoded puzzles.

Background Description

There are a variety of puzzle games in the prior art. Those of relevance to the present invention will be described briefly here.

The Maze of Games (Paper Puzzle Book)

The Maze of Games is a paper page book that features a different puzzle on every page (mostly in the form of word puzzles). It is suggested to follow the instructions given on each page to follow the story of the puzzles, attempting to prevent readers from skipping all over the book. However, nothing actually prevents the puzzler from skipping critical story elements to solve a puzzle out of turn. Consequently, actual play of the paper puzzle book lacks consistency and the guiding design element is thus useless. Furthermore, this paper puzzle book lacks a physical, mechanical interactive quality.

Wooden Book Puzzles (Boxes Shaped Like Books)

There are a good number of various puzzle boxes that take the shape of a book and they generally use some sort of bolting system to lock the lid. None of these puzzle boxes have more than one puzzle in them, so they are not "books" in the sense of being able to turn pages.

Mechanical Puzzles/Wooden Puzzles

Despite thousands of puzzles being made and sold each day in the mass production puzzle market, there is little variance in the puzzle mechanics or the type/category of puzzle used. The puzzles can be as simple as disassembling the parts of a structure to navigating a maze to unwinding an object from a rope. Puzzles in this category that are more challenging are mostly hand crafted by master puzzle makers and generally are only sold in person or on the internet rather than at retail locations. More importantly, these puzzles generally have only one solution or way of solving a puzzling problem. Once this solution is discovered, the puzzle loses its intrigue.

High-End Puzzle Boxes

High-End Puzzle Boxes feature magnificent designs, intricate mechanical locking systems and also a very high price tag. They are produced in such limited volume (25-100 total) and at such high cost ($500) that they are rarely available to the general public. Furthermore, they are single puzzles. While they demonstrate craftsmanship, design, workability, and uniqueness, they fail to capture any significant part of the general public puzzling market, leaving profits to mass produced products such as Rubik's cube and small, simple wooden puzzles.

There is need, therefore, for a mechanical puzzle concept that links together different puzzles in single structure and is of a design and construction that can be produced in quantity or individually.

SUMMARY OF THE INVENTION

The present invention is a linked sequence of mechanically encoded puzzle pages, each page is comprised of multiple planar layers interconnected to implement the puzzle design of the page. The puzzle of each page must be solved to disengage a latching mechanism enabling the player to turn the page and begin solving the puzzle in the next page. Similarly for the next page, and each succeeding page until the last page, solution to the puzzle by the player will disengage a latching mechanism. The latching mechanism holds the active page being solved by the player to the next page. In the implementation of the invention described in this disclosure the latching mechanism comprises a hooking piece protruding in a perpendicular direction from the planar front surface of the next page, where the hooking piece fits into an opening on the planar back surface of the active page and a blocking piece on the active page is aligned between the hook portion and the exit to the opening, thereby preventing the hooking piece on the next page from disengaging from the active page. In the implementation described in the present disclosure the hook portion is an extension of the hooking piece at right angles to the hooking piece, and therefore in a direction parallel to the planar surface of the active page. Correspondingly, the blocking piece is a flat bolt The implementation of the invention described in the present disclosure is completely made from wood but the invention can also be implemented in metal, plastic, acrylic and various other materials that can be cut on a laser cutter that is built to handle said materials. The puzzle book is constructed by using a three-dimensional (3D) modeling program while maintaining a two-dimensional (2D) layer by layer construction. This means that every layer used in the construction of the puzzle book is no thicker than a quarter of an inch (0.25"). while its length and width vary, this does not include the wooden dowels which can vary in length up to 1" and have varying diameters from ⅛" to ½". Once all the pieces are fully designed out on the 3D program, each piece is then placed on a laser cutting template sheet, laid flat so only the length and width can be seen for each piece. The pieces are arranged on the template to use as much of the given space as possible to reduce waste and time when cutting. Once the pieces for each page are laid out, the template is sent to the laser cutter which then proceeds to cut along the length and width edges of each piece, the thickness of each piece is determined by the board/wood/material thickness that is placed in the laser cutter. Once the laser cutter has finished cutting out each piece, the cut pieces are removed from the laser cutter and excess material is thrown out or used for scrap. After all of this, the pieces are then sanded, varnished (if needed), and finally assembled together to form each one of the five puzzle pages that make up the Codex.

BRIEF DESCRIPTION OF THE DRAWINGS

The foregoing and other objects, aspects and advantages will be better understood from the following detailed description of a preferred embodiment of the invention with reference to the drawings, in which:

FIGS. 1A-1C show the hook and lock mechanism used in the implementation detailed in the present disclosure. FIGS. 1D-1F show alternative hook and lock mechanisms in accordance with the spirit of the invention.

DETAILED DESCRIPTION OF A PREFERRED EMBODIMENT OF THE INVENTION

Figure 1C:
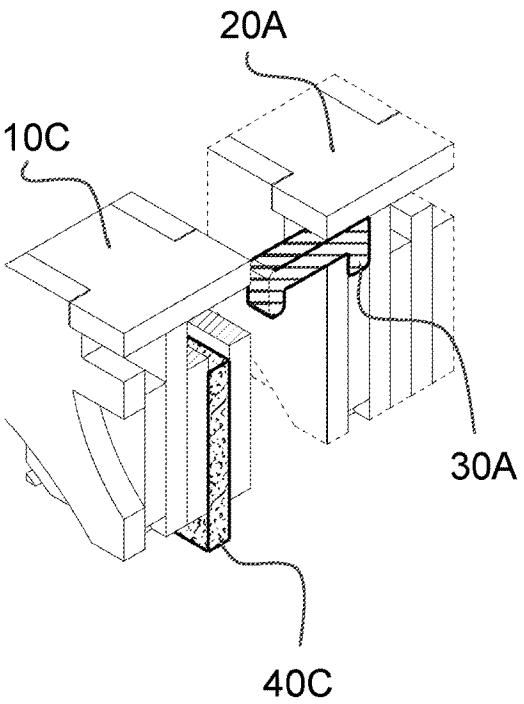
FIGS. 1A-1F are schematic drawings of hook and lock mechanisms according to the invention.

Codex Silenda—the name of the invention—is a wooden puzzle book, comprised of multiple puzzles that act like pages found in an actual book. The exemplar used for this disclosure is a book of seven pages, although it is sufficient for enabling those skilled in the art to make and use the invention to give a detailed description of only two pages to show how they are connected. The invention can be implemented in a mechanical book with as few as two pages. The implementation described herein is completely made from wood but the invention can also be made in metal, plastic, acrylic and various other materials that can be cut on a laser cutter that is built to handle such alternate materials. Each page is constructed by using a 3D modeling program while maintaining a 2D piece by piece construction of each of a plurality of layers. This means that every piece used in the construction of the puzzle book is no thicker than 0.25" while it's length and width vary, this does not include the wooden dowels which can vary in length up to 1" and have varying diameters from ⅛" to ½".

Once all the pieces are fully designed out on the 3D program, each piece is then placed on a laser cutting template sheet, laid flat so only the length and width can be seen for each piece. The pieces are arranged on the template to use as much of the given space as possible to reduce waste and time when cutting. Once the pieces for each page are laid out, the template is sent to the laser cutter which then proceeds to cut along the length and width edges of each piece. The thickness of each piece is determined by the board/wood/material thickness that is placed in the laser cutter. Once the laser cutter has finished cutting out each piece, the cut pieces are removed from the laser cutter and excess material is thrown out or used for scrap. After all of this, the pieces are then sanded, varnished (if needed), and finally assembled together to form each one of the plurality of puzzle pages that make up the Codex.

Each of the seven puzzle pages of the exemplar Codex will now be described. It is to be understood that the invention can be practiced with a variety of different puzzle pages, arranged in a variety of sequences provided that each puzzle page is locked to the succeeding page and the puzzle embodied in the page must be solved in order to disengage the lock and allow the solved page to be turned over like the page of a book, exposing the succeeding page and its puzzle for solution.

Mechanical Iris/Cover Page

The Mechanical Iris page is the first page of the Codex, and therefore has no hook portion of the hook and lock mechanism on its front side. However, it has a locking portion on its back side, thus adapting this puzzle page (the Mechanical Iris) to serve as the first page of the Codex. It is therefore apparent that by adding a hook portion at the front of the puzzle page for insertion into a hole on the back side of a preceding page the Mechanical Iris puzzle page could become usable as an interior page for the Codex. Correspondingly, any interior page could be adapted to serve as the first page of the Codex by removing the hook portion from its front side.

Its outer most dimensions are as follows 12" Long (tall if upright)×10.5" Wide (including hinges)×1.5" thick. The front of the page resembles an "X" shape design with a central aperture that is comprised of five blades, resembling a camera aperture. There is a small handle that is attached to an inner wheel which in turn forces the aperture blades to rotate out or in depending on the direction the wheel is turned. This turning wheel cannot be moved however if the four locking bolts are not disengaged. These four locking bolts can be found underneath each arm the X Shape Design but only when the four rounded "keys" are removed. These keys look like a half circle with two legs branching down parallel to each other with a gap between the legs. This allows the key to be inserted or removed from the slot created by the X branch.

The keys serve to hide the location of the four locking bolts, creating a search-and-find style of puzzle to open the aperture and disengage the Y shaped bolts that are preventing the next page from being accessed. Once the Y Shaped bolts are disengaged, the Player will now be able to flip the page over to look at the back side of the first page and the front of the $2^{nd}$ page. Looking at the back of the $1^{st}$ page, there will be found the two square openings that the $2^{nd}$ page's hooks just came out of. To re-lock the page, align and close the $1^{st}$ page onto the $2^{nd}$ page, while keeping the $2^{nd}$ page's hooks aligned with the square openings. Once the two pages are pressed together flush this will re-engage the Y Shaped Bolts on the $1^{st}$ page, thus locking the $1^{st}$ page to the $2^{nd}$ page. The rest of the back of the $1^{st}$ Page serves as a space for adding text/images in the form of a story, instructions, and/or hints for solving the puzzle.

Rotating Maze

The Rotating Maze is the $2^{nd}$ page of the Codex as implemented in the present disclosure, however it does not have to be the $2^{nd}$ page if another order is desired. All inner pages (2, 3, 4, 5, and 6) are interchangeable, with only the first (Mechanical Iris) and last (Cryptex Lock) pages being adapted to serve as beginning and end pages of the Codex. The page's outer dimensions are as follows 12" long (tall if codex is upright)×10.5" wide (including hinges)×1.5" thick. The front of the page features a large wheel with multiple slots cut out of the face, creating a partial view of the maze below the wheel. This maze is traversed by a single peg which is found at the center of the wheel. However, this peg can only travel in a single straight slot found on the wheel. Yet the peg can still move sideways due to the turning on the partially cut wheel which allows it to move through the maze, depending on the dual motion of sliding in the slot and the turning of the wheel. The peg must travel through the entire maze until it reaches the end where the peg can then be inserted and slid to the left in order to disengage the bolt that is preventing the next page from being opened. On the back side of this page, two holes are found that allow the next page's bolt hooks/grabbers to pass through. This is where the Rotating Maze's bolt slides underneath each hook, locking the two pages together until it is disengaged. The rest of the back of the Rotating Maze page serves as a space for adding text/images in the form of a story, instructions and/or hints.

Paradox Sliders

The Paradox Sliders puzzle is the $3^{rd}$ page of the Codex, however it does not have to be the $3^{rd}$ page if another order is desired. All inner pages (2, 3, 4, 5, and 6) are interchangeable, with only the first (Mechanical Iris) and last (Cryptex Lock) pages being adapted to serve as beginning and end pages of the Codex. The $3^{rd}$ page's outer dimensions are as follows: 12" long×10.5" wide×1.25" thick. The front of the page features a series of sliders that are covered by a perpendicular running board. The corners and edges of the page serve as the frame and design aesthetic of the page, while also keeping in the sliders themselves. Below these sliders is yet another visible layer of the page that has six columns featuring runes and letters, which in turn form seven rows located on both the top and bottom visible halves of the fourth lowest layer (the one beneath the sliders). As for the fourteen sliders, there is no discernible difference between any of them, except for the two innermost sliders. These two sliders have milled out channels running along their bottom halves. This channel prevents the two inner board hooks from being unlocked unless the slider is correctly positioned, which then allows the puzzle user to pull the hook back and then straight out, repeating this with the second hook. Once this is done, the upper large board can be removed, and the bolts can be disengaged by pulling the bolt sliders towards the center of the page. On the back side of this page, two holes can be found near the top and bottom that allow the next page's hooks/grabber to pass through and be engaged by the Paradox Slider page's bolts. The rest of the back of Paradox Sliders page serves as a space for adding text/images in the form of a story, instructions, and/or hints to solve the puzzle.

Ven Dais

The Ven Dais Puzzle page is the $4^{th}$ page of the Codex, however it does not have to be the $4^{th}$ page if another ordering desired. All inner pages (2, 3, 4, 5, and 6) are interchangeable, with only the first (Mechanical Iris) and last (Cryptex Lock) pages being adapted to serve as beginning and end pages of the Codex. The Ven Dais page's outer dimensions are as follows 12" long (tall if codex is upright)× 10.5" wide (including hinges)×1.5" thick. The front of the page features a series of wheels, each stacked on top of one another and all turning on the same axis. All three wheels feature portions of a pattern. This same pattern can be seen on an even smaller disc that is permanently attached to the center of the uppermost wheel. Four outer voids feature 9 notches in each quadrant, depicting positions of where to rotate a wheel to.

The Uppermost Wheel, must be aligned so that it's arrow is located in the Top Left Quadrant. The wheel's arrow is then positioned on the $4^{th}$ notch, starting at the top of the quadrant and then counting counter clockwise. The Middle Wheel must be aligned so that it's arrow is located in the Top Right Quadrant, this time 3 notches over coming from the same counter clockwise direction. Finally, the Lowest Wheel must be aligned so that it's arrow is located in the Bottom Left Quadrant. This time however, the arrow is located 2 notches from the bottom going in a clockwise direction. Once all three wheels are positioned thus, the pattern should be visible since each of the wheels counter each of the other ones' voids. Next, pull on the two pegs located at the top and bottom of the puzzle page and pull them simultaneously back towards the Hinge Side. On the back side of this page, two holes can be found near the top and bottom that allow the next page's hooks/grabber to pass through and be engaged by the Master Keys page's bolts. The rest of the back of the Ven Dais page serves as a space for adding text/images in the form of a story, instructions, and/or hints for solving the puzzle.

Master Keys

The Master Keys Puzzle page is the $5^{th}$ page of the Codex, however it does not have to be the $5^{th}$ page if another order is desired. All inner pages (2, 3, 4, 5, and 6) are interchangeable, with only the first (Mechanical Iris) and last (Cryptex Lock) pages being adapted to serve as beginning and end pages of the Codex. The Master Keys page's outer dimensions are as follows 12" long (tall if codex is upright)×10.5" wide (including hinges)×1.25" thick. The Master Keys page features 5 sliders along the side opposite from the hinge panel. Then there are two more, different looking sliders found at the top and bottom of the puzzle page. These two sliders in turn prevent the bolts beneath them from being disengaged. In order to be able to remove the two sliders, the five sliders along the side must be properly pulled out to the proper position so that the two slider's locking pegs may pass freely over the sliders and out the top or bottom of the page. Once both sliders are removed, the bolts can be disengaged. On the back side of this page, two holes can be found near the top and bottom that allow the next page's hooks/grabber to pass through and be engaged by the Master Keys page's bolts. The rest of the back of the Master Keys page serves as a space for adding text/images in the form of a story, instructions, and/or hints to solve the puzzle.

Merchant's Emporium

The Merchant's Emporium Puzzle page is the $6^{th}$ page of the Codex, however it does not have to be the $6^{th}$ page if desired. All inner pages (2, 3, 4, 5, and 6) are interchangeable, with only the first (Mechanical Iris) and last (Cryptex Lock) pages being adapted to serve as beginning and end pages of the Codex. The Merchant's Emporium page's outer dimensions are as follows 12" long (tall if codex is upright)× 10.5" wide (including hinges)×1.5" thick. The Merchant's Emporium page features a 5×7 grid of cut out square voids and another layer beneath that holds a series of single and double square tiles that move beneath the grid. Every void has either a single or half of a double beneath it, save for two different voids. One void had nothing in it and the other void held a key like object instead. The Key had a handle with four arms, similar to a bathtub knob. The body was just a simple peg that was long enough to reach through 3 Layers of wood in the puzzle book. The objective is to reach the hidden bolts near the top and bottom right corners of the page. To do this, the player must rearrange the tiles so that the voids match up over the top of one the hidden bolt locations. Then the player will take the key object, insert it into the channel and then proceed to disengage the bolt. On the back side of this page, two holes can be found near the top and bottom that allow the next page's hooks/grabber to pass through and be engaged by the Merchant's Emporium page's bolts. The rest of the back of the Merchant's Emporium page serves as a space for adding text/images in the form of a story, instructions, and/or hints.

Cryptex Lock

The Cryptex Lock is the $7^{th}$ and last page of the Codex. The last page has the hook portion of the hook and lock mechanism on its front side but has no locking portion on its back side, thus adapting this puzzle page (the Cryptex Lock) to serve as the last page of the Codex. It is therefore apparent that by adding a locking portion at the end of the puzzle page and corresponding holes on its back side for receipt of a hook portion from a succeeding page the Cryptex Lock puzzle page could become usable as an interior page for the Codex. Correspondingly, any interior page could be adapted to serve as the last page of the Codex by removing the locking portion and hole from its back side.

The Cryptex Lock page's outer dimensions are as follows 12" long×10.5" wide×1.25" thick. The front of the page features an X shaped design on the upper portion of the page which acts as a barrier/holder to four discs found beneath the X shape. These four discs/wheels have grooves cut into the underside that allows them to turn a full 360 degrees over the tops of two bolts. Each bolt contains two pegs which are found separately position so they are located beneath the channels of each one of the four discs. This prevents the bolts from being disengaged until the discs are properly lined up in which an exit channel allows the bolt's pegs to slide through, releasing the bolts found below in the lower portion of the page, known as the compartment section. Each disc also features space for the adding of text/images to help in the alignment of the discs to properly match the exit channel to the position of the bolt pegs. Once all four discs are aligned properly, the two bolts are then slid in opposing directions in which the lower portion of each bolt also disengages from the bolt holders located on the underside of the Compartment Door. Once the bolts are disengaged, the compartment door can be removed straight out of the page, exposing the interior compartment area found in the lower portion of the Cryptex Lock page. On the back side of this page, no holes are found as this is the last page of the Codex. However, there is space on the entire back of the Cryptex Lock page that serves as a space for adding text/images in the form of a story, instructions, and/or hints for solving this puzzle page.

Further Detail Regarding Two Exemplar Pages and the Hook and Lock Mechanism

With reference to the drawings for two exemplar pages the hook and lock mechanism for linking one page to the next will now be described.

Mechanical Iris/Cover Page Annotated to Drawing FIGS. 2A-2I

The Mechanical Iris page is the first page of the Codex, and therefore has no hook portion of the hook and lock mechanism on its front side. However, it has a locking portion on its Back Panel (106), thus adapting this puzzle page (the Mechanical Iris) to serve as the first page of the Codex. It is therefore apparent that by adding a hook portion at the front of the puzzle page for insertion into a hole on the back side of a preceding page the Mechanical Iris puzzle page could become usable as an interior page for the Codex. Correspondingly, any interior page could be adapted to serve as the first page of the Codex by removing the hook portion from its front side.

Its outer most dimensions are as follows 12" Long (tall if upright)×10.5" Wide (including hinges)×1.5" thick. The front of the page resembles an "X" shape design, comprised of the Engraved Cover (115), four Key Placeholder Spacers (104), and four Key Placeholders (109). There is a central aperture that is comprised of five Iris Blades (105), resembling a camera aperture. Attached to the five Iris Blades (105) are two types of pegs, one for each of the five Iris Blades (105). The first type are the five 4 Layer Thick Pegs (Q4) which connect the Iris Blades (105) to the Central Control Ring (103), the Cover Spacer Ring (102), the Front Panel (107), and the Engraved Cover (115). The second type of peg is the 2 Layer Thin Pegs (E2) which are found on both the Iris Blades (105) and the Central Control Ring (103). Connecting these two component's (105 and #103) 2 Layer Thin Pegs (E2) are the five Iris Arms (113). These five Iris Arms (113) pull and push the Iris Blades (105) open and closed whenever the Central Control Ring (103) is turned. There is also a 5 Layer Thick Peg (Q5), known from hereon as Turning Peg (Q5), with a Small Peg Thickener (111) attached at its base, and these two components are attached to the Central Control Ring (103) and the Cover Spacer Ring (102). The Central Control Ring (103) and the Cover Spacer Ring (102) are enclosed by two of the Open Gap Housings (117) and two of the Closed Gap Housings (116). The Turning Peg (Q5) sticks out through an opening in the Front Panel (107) towards the user. Turning the Turning Peg (Q5) forces the Iris Blades (105), Central Control Ring (103), and the Cover Spacer Ring (102) to rotate out or in depending on the direction the Turning Peg (Q5) is moved. Movement can be blocked however by the four Small Lock Bolts (121) if they are not disengaged properly. These four Small Lock Bolts (121), each with a 3 Layer Thin Peg (E3), are located underneath each Key Placeholder (104) but are accessed only by sliding flat tool between the Key Placeholder (104) and the Front Panel (107) and pushing one of the 3 Layer Thin Pegs (E3). In order to access the gaps between the Key Placeholder (104) and the Front Panel (107) is by removing the four Rounded Keys (101). These Rounded Keys (101) look like a half circle with two legs branching down parallel to each other with a gap between the legs. This allows the Rounded Key (101) to be inserted or removed from the slot created by the Key Placeholder (104) and the Key Placeholder Spacer (104).

The Rounded Keys (101) serve to hide the location of the four Small Lock Bolts (121), creating a search-and-find style of puzzle to open the Iris Blades (105) and disengage the Y Shape Bolts (110) that are preventing the next page from being accessed. These Y Shape Bolts (110) operate in a sliding motion which is guided by two types of components that also serve the duel function of holding the mechanical Iris Arms (113) in their place, preventing jamming. Y Bolt Guide Panels (108) are located on both sides of the Y Shape Bolts (110) and span almost the entire page's length. They are connected to the page by two 6 Layer Thin Pegs (E6). The second component type is a Central Path Guide (112) located between the upper arms of the Y Shape Bolts (110); the Central Path Guides (112) are held in place by 3 Layer Thick Pegs (Q4). Once the Y Shaped Bolts (110) are disengaged, the Player will now be able to flip the page over to look at the Back Panel (106) of the first page and the front side of the $2^{nd}$ page. Looking at the Back Panel (106) of the $1^{st}$ page, there will be found the two square openings that the $2^{nd}$ page's hooks just came out of. To re-lock the page, align and close the $1^{st}$ page onto the $2^{nd}$ page, while keeping the $2^{nd}$ page's hooks aligned with the square openings. Once the two pages are pressed together flush, the user will then re-engage the Y Shape Bolts (110) on the $1^{st}$ page, thus locking the $1^{st}$ page to the $2^{nd}$ page. The rest of the Back Panel (106) of the $1^{st}$ Page serves as a space for adding text/images in the form of a story, instructions, and/or hints for solving the puzzle.

Rotating Maze Annotated to Drawing FIGS. 3A-3E

The Rotating Maze is the $2^{nd}$ page of the Codex as implemented in the present disclosure. The front side of the Rotating Maze features a multi-layer facet, featuring the Front Panel (211), Wheel Guide Layer (202), the Maze Wall Layer (210), the Maze Floor Layer (201), and the Large Wheel (203). The Large Wheel (203) features multiple slots cut out of the face, creating a partial view of the two Maze Wall and Floor Layers (210 and #201) located below the Large Wheel (203). There is also a single slot that runs from the center of the Large Wheel (203) to the edge and inside this slot are three small components, Grab Wheel (208), 5 Layer Thin Peg (E5), and Thin Peg Thickener (207). With the Grab Wheel (208) on the outside of the Large Wheel (203) facing the user, the Thin Peg Thickener (207) on the other hand traverses between the walls of the Maze Wall Layer (210). However, this Thin Peg Thickener (207) can only travel in slot of the Large Wheel (203), relying on the turning motion of the Large Wheel (203) to turn corners in the maze. The Thin Peg Thickener (207) must travel through the entire Maze Wall Layer (210) until it reaches the end where the Thin Peg Thickener (207) can then be inserted and slid to the left in order to disengage the Large Odd Bolt (205) that is preventing the next page from being opened. This Large Odd Bolt (205) is guided by the Bolt Guider Layer (206), which is held in place by four 3 Layer Thick Pegs (Q4). The Large Odd Bolt (205) is guided by two 3 Layer Thin Pegs (E3) and is also prevented from moving too far to the right by the Un-Cut Corners (209*a*) which also serve as spacers between the Back Panel (204) and the Maze Floor Layer (201). The opposite corners have the Cut Corners (209*b*) instead. Both Un-Cut Corners (209*a*) and Cut Corners (209*b*) are held in place by glue and the 6 Layer Thick Pegs (Q6) which run the full thickness of the Rotating Maze Page, from Back Panel (204) to the Front Panel (211). On the back side of this page, two holes are found in the Back Panel (204) that allow the next page's Bolt Hooks (216) to pass through. This is where the Rotating Maze's Large Odd Bolt (205) slides underneath each hook, locking the two pages together until it is disengaged. The rest of the Back Panel (204) of the Rotating Maze page serves as a space for adding text/images in the form of a story, instructions and/or hints for solving the puzzle.

Hook and Lock Mechanism as Shown in FIGS. 1A-1F

Figure 1B:
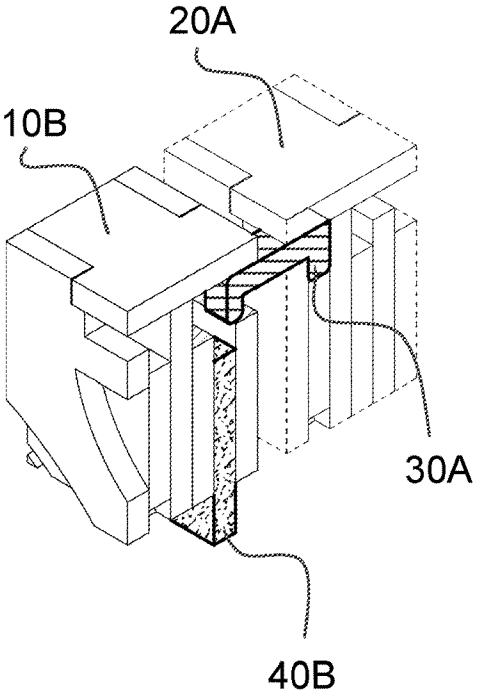
Figure 1A:
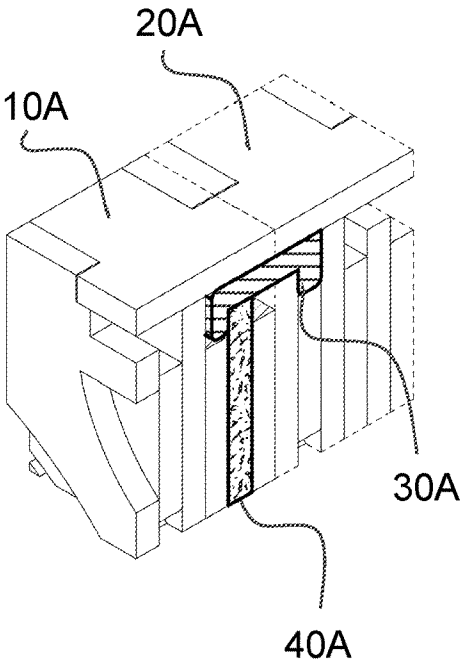

Each puzzle page (10A) is locked to the following page (20A) by a locking mechanism as shown in FIG. 1A. The schematics shown are cutouts showing enlarged images of the mechanism. The hook portion (30A) of the mechanism is immovably attached to the following page (20A). The locking portion (40A) is a moveable piece of the puzzle page (10A). When the moveable piece (40A) is fully engaged with the hook portion (30A) as shown in FIG. 1A the two pages (10A, 20A) are locked and cannot separate.

When the puzzle page (10A) is solved, the moveable locking portion (40A) becomes disengaged (40B) from the hook portion (30A), as shown in FIG. 1B, allowing the puzzle page (10B) to disengage from the following page (20A). The disengagement is shown more fully in FIG. 1C, where the moveable locking portion (40C) within the puzzle page (10C) is fully disengaged from the hook portion (30A) attached to the following page (20A).

Figure 1F:
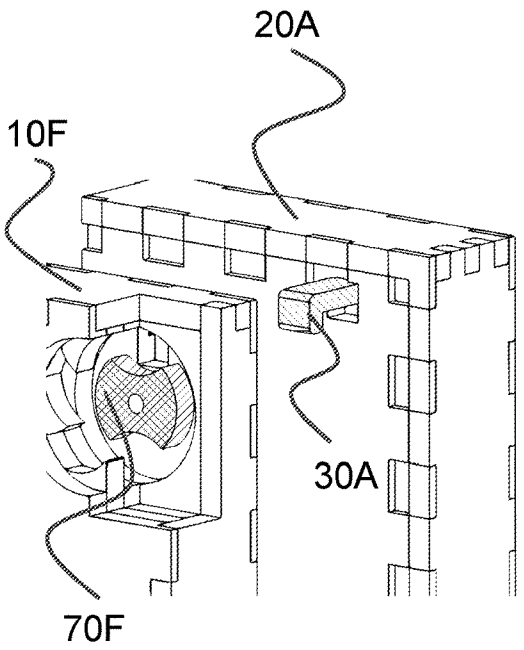
Figure 1E:
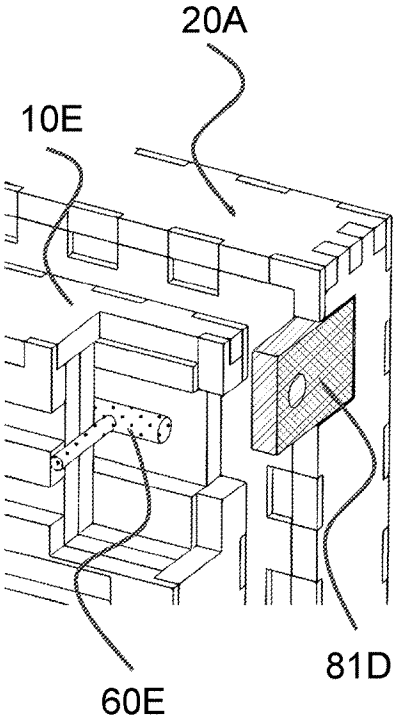
Figure 1D:
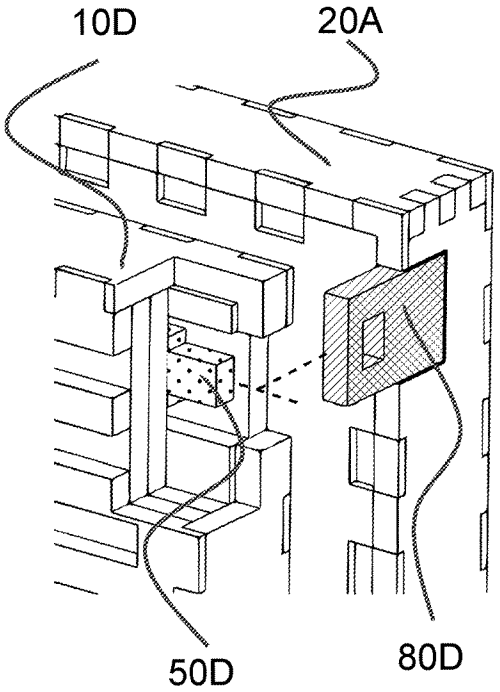
Figure 2A:
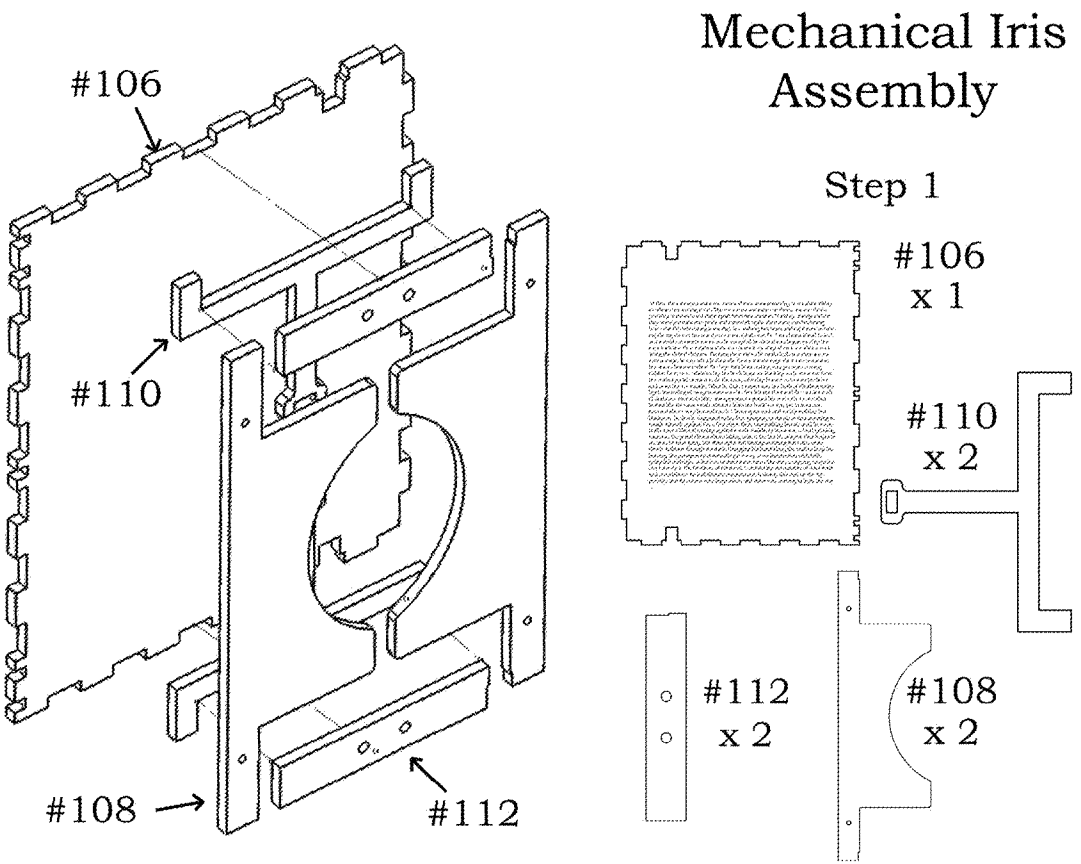
FIGS. 2A-2I are schematic diagrams showing steps (steps 1 through 9) for assembling successive layers of the Mechanical Iris puzzle page. The operation of the puzzle will be evident to those skilled in the art from these assembly instructions.
Figure 2B:
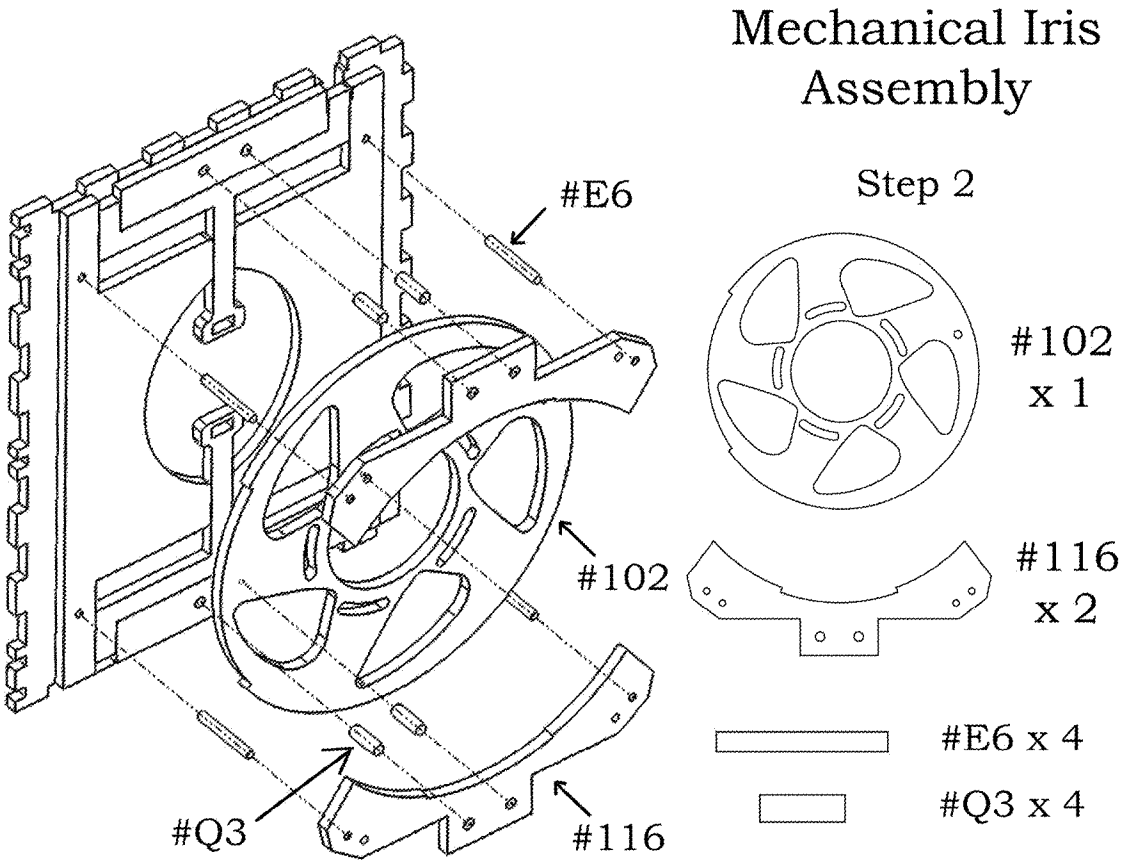
Figure 2C:
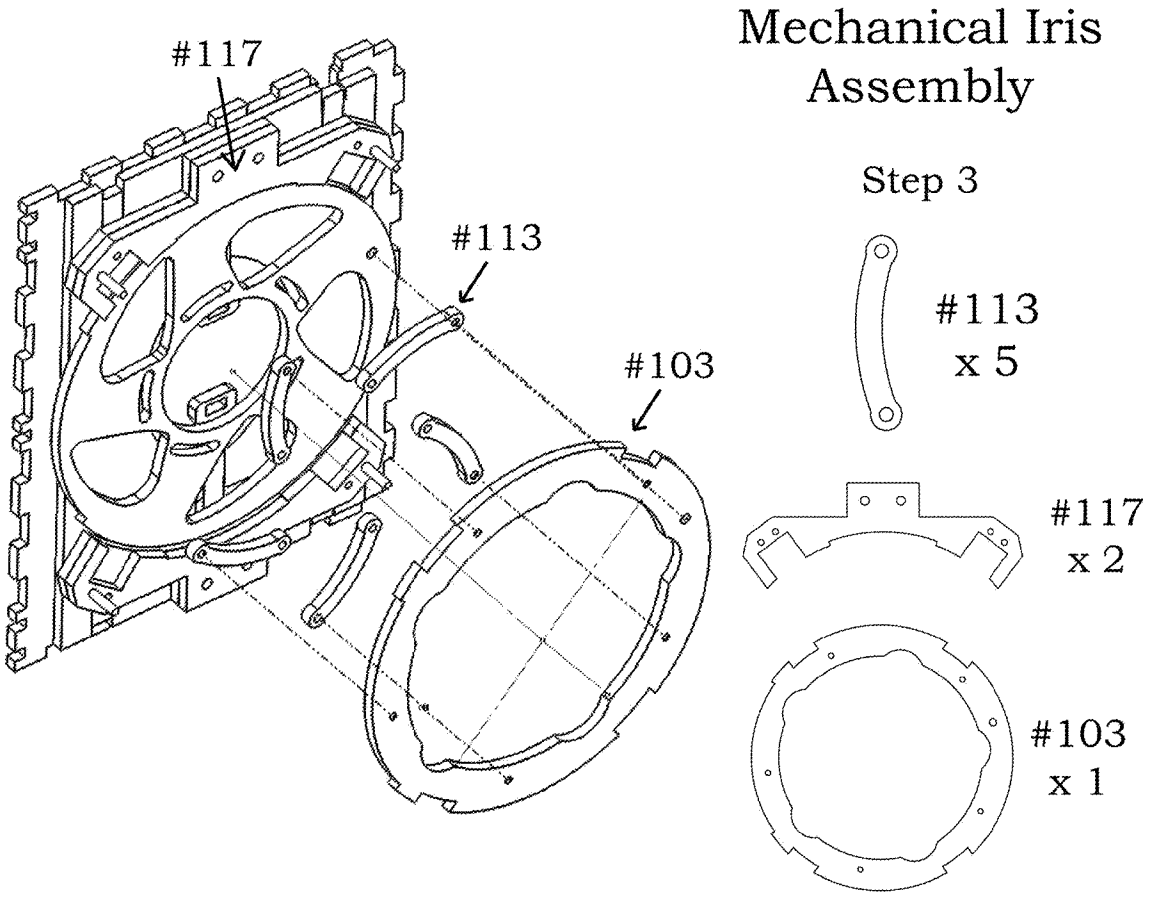
Figure 2D:
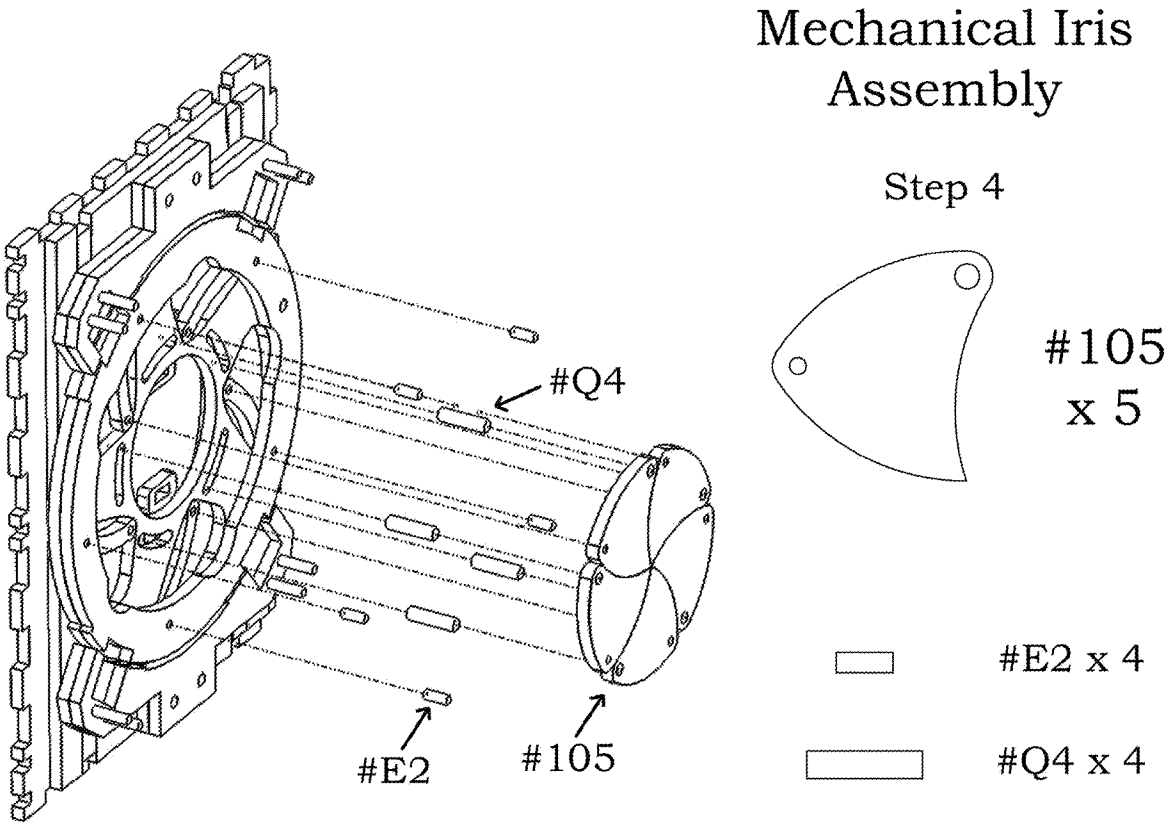
Figure 2E:
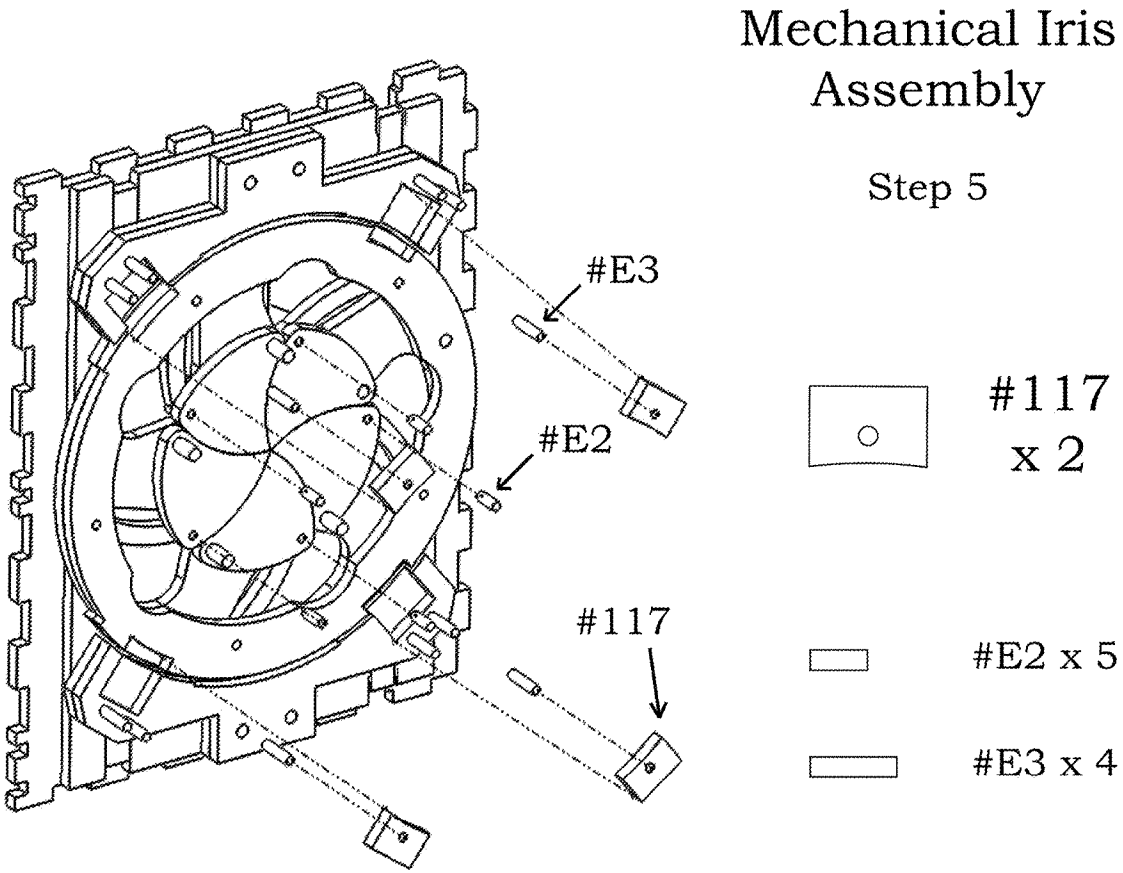
Figure 2F:
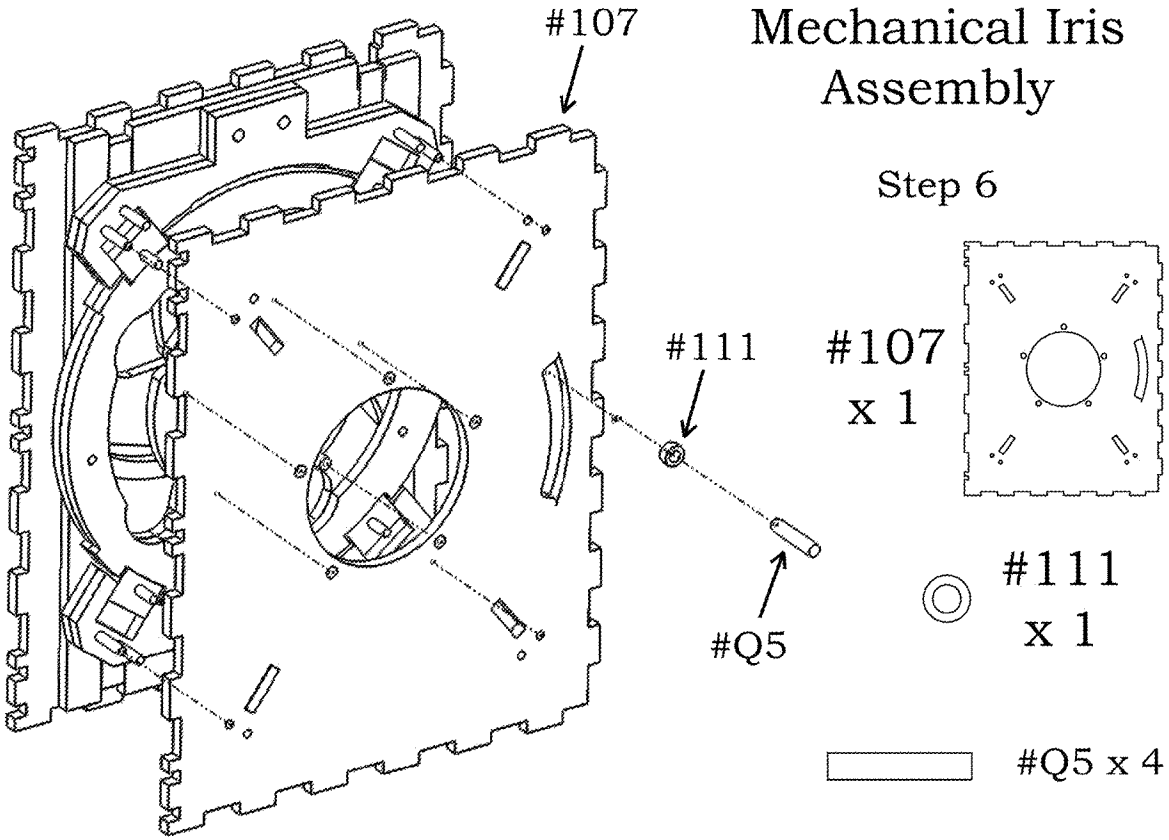
Figure 2G:
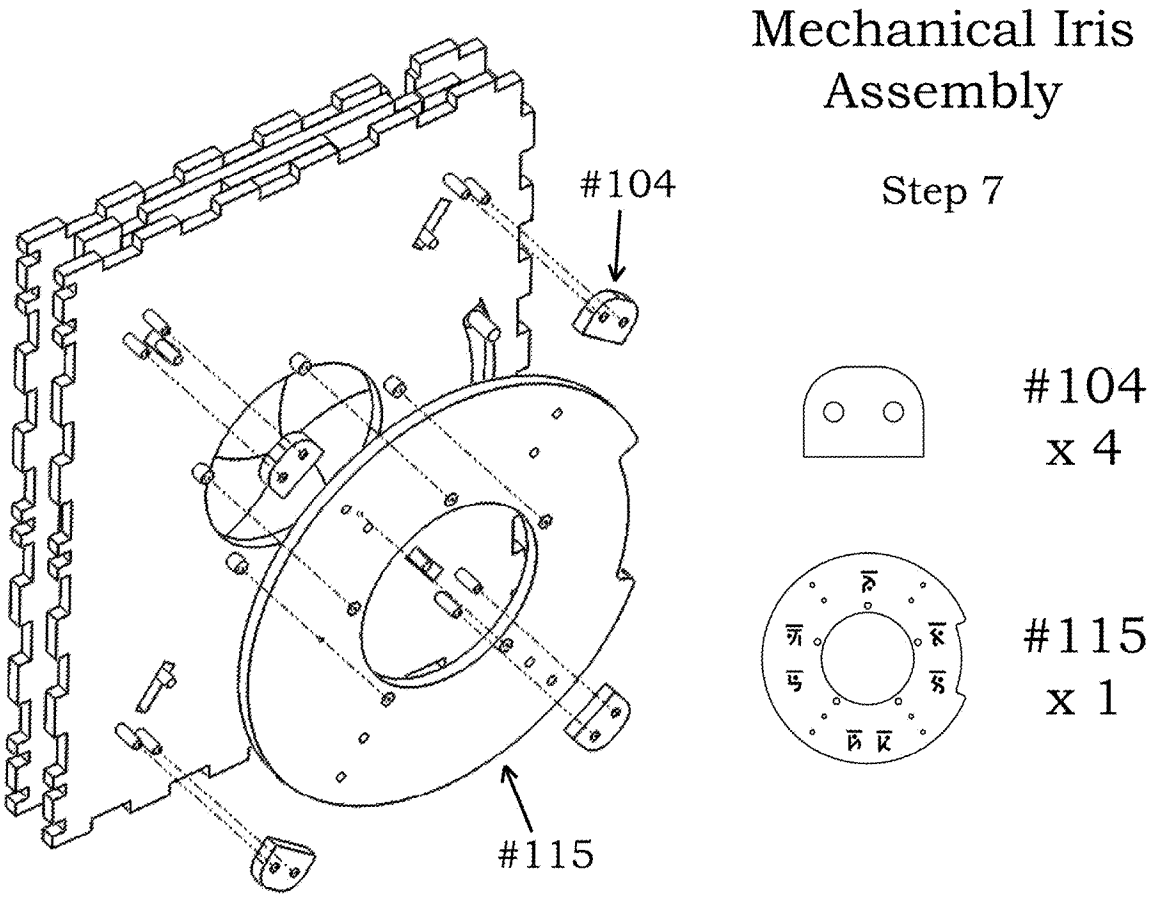
Figure 2H:
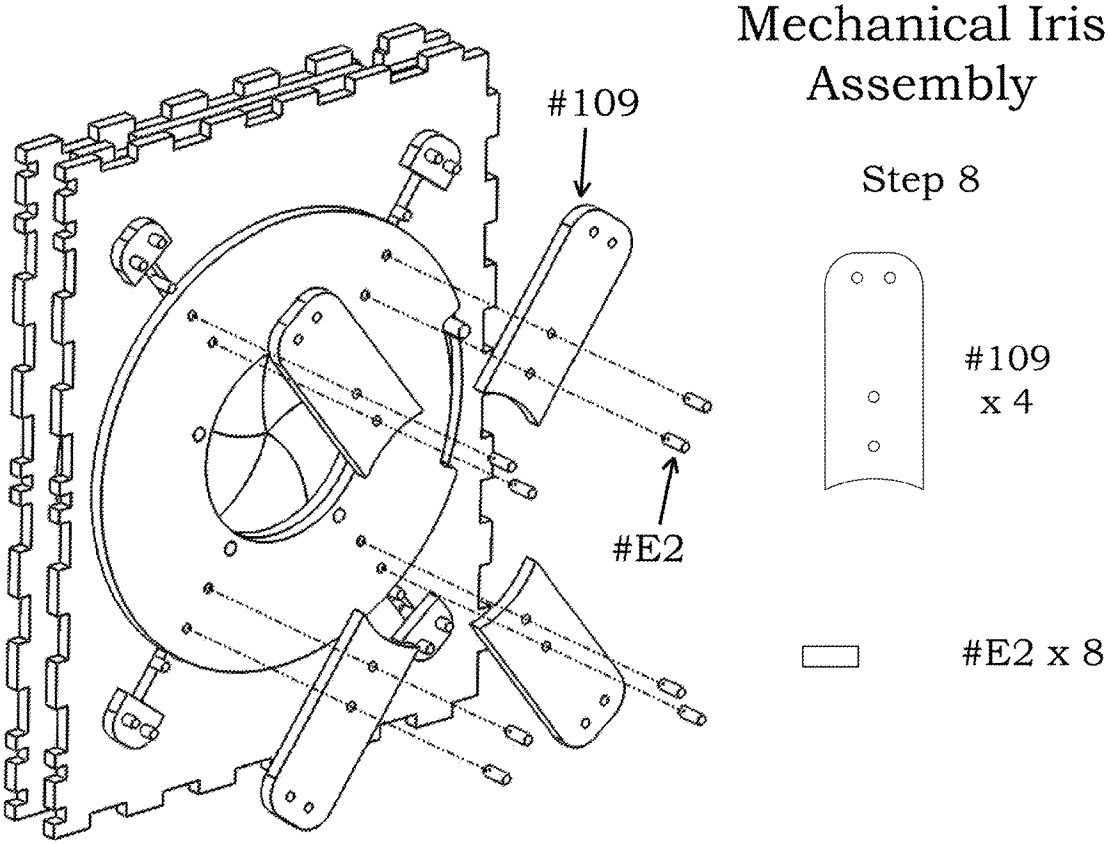
Figure 2I:
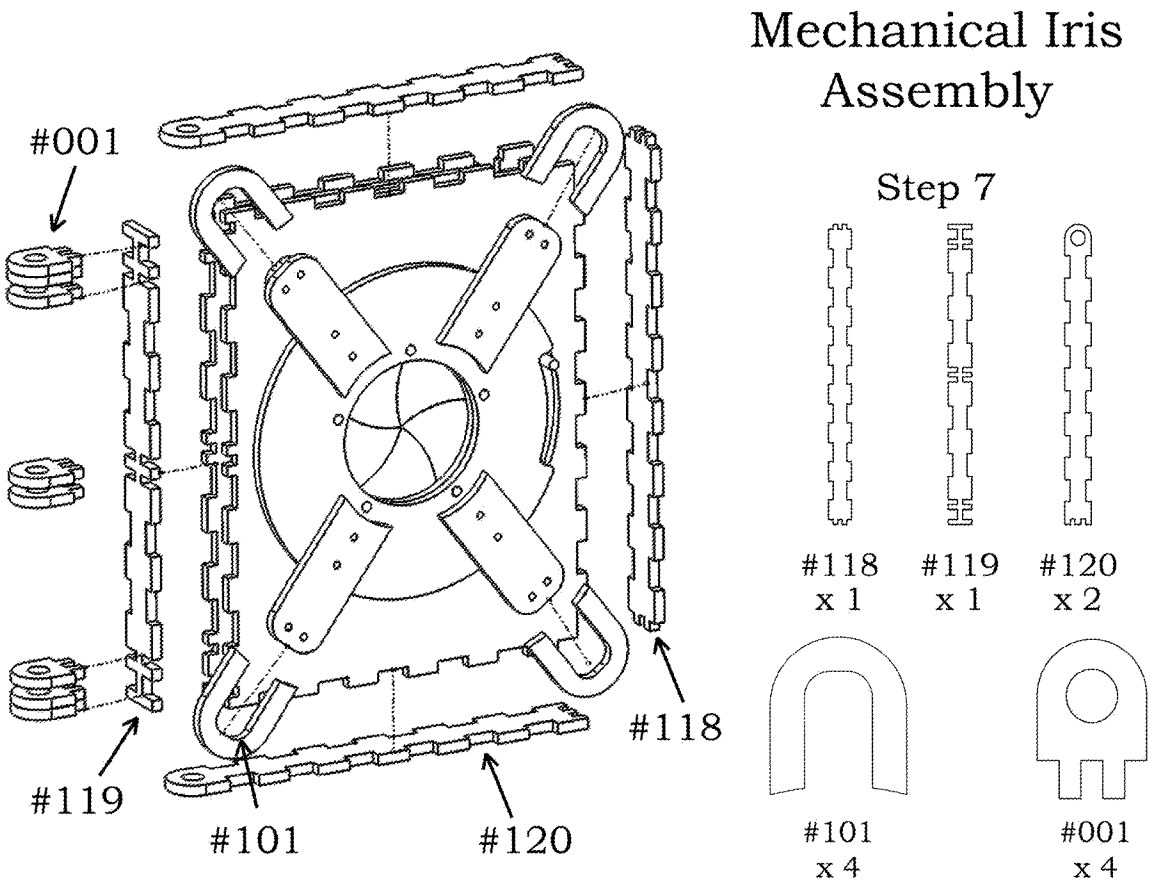
Figure 3A:
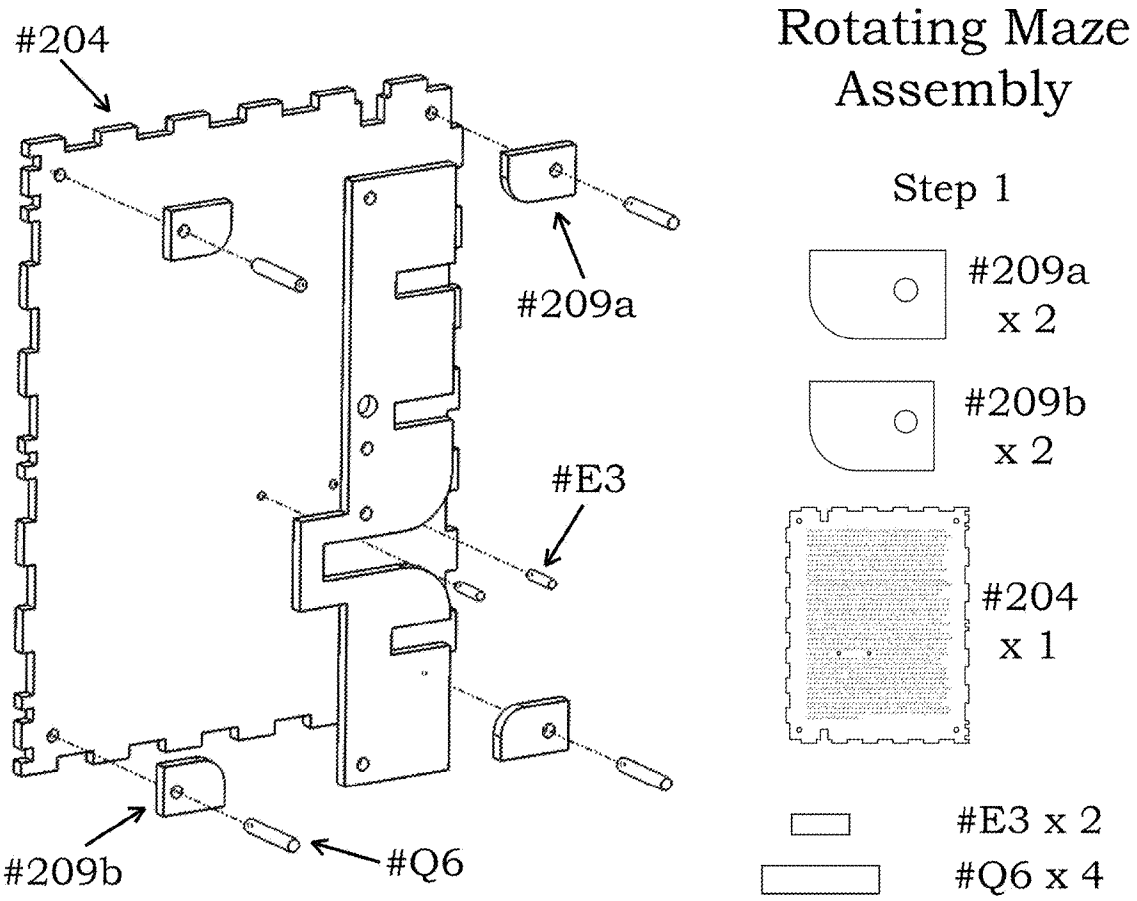
FIGS. 3A-3E are schematic diagrams showing steps (steps 1 through 5) for assembling successive layers of the Rotating Maze puzzle page. The operation of the puzzle will be evident to those skilled in the art from these assembly instructions.
Figure 3B:
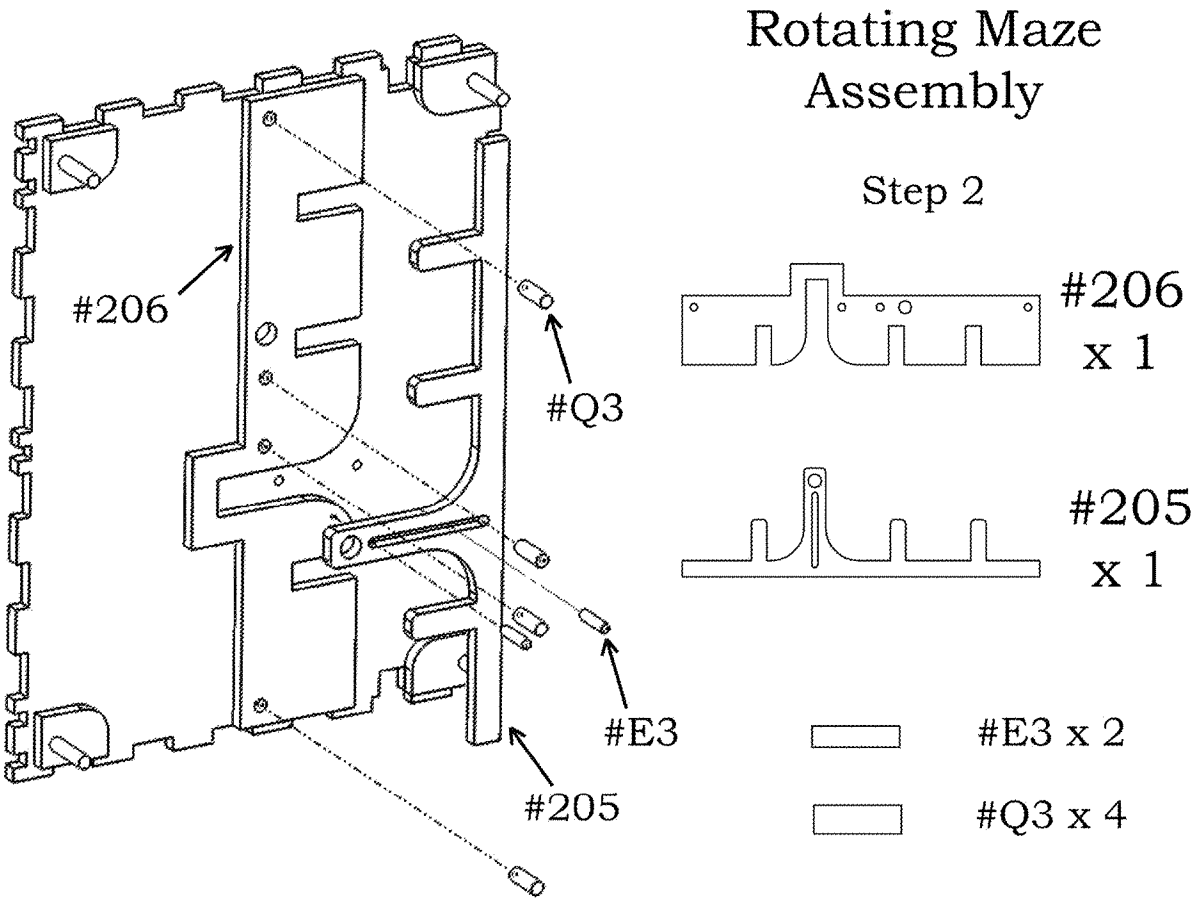
Figure 3C:
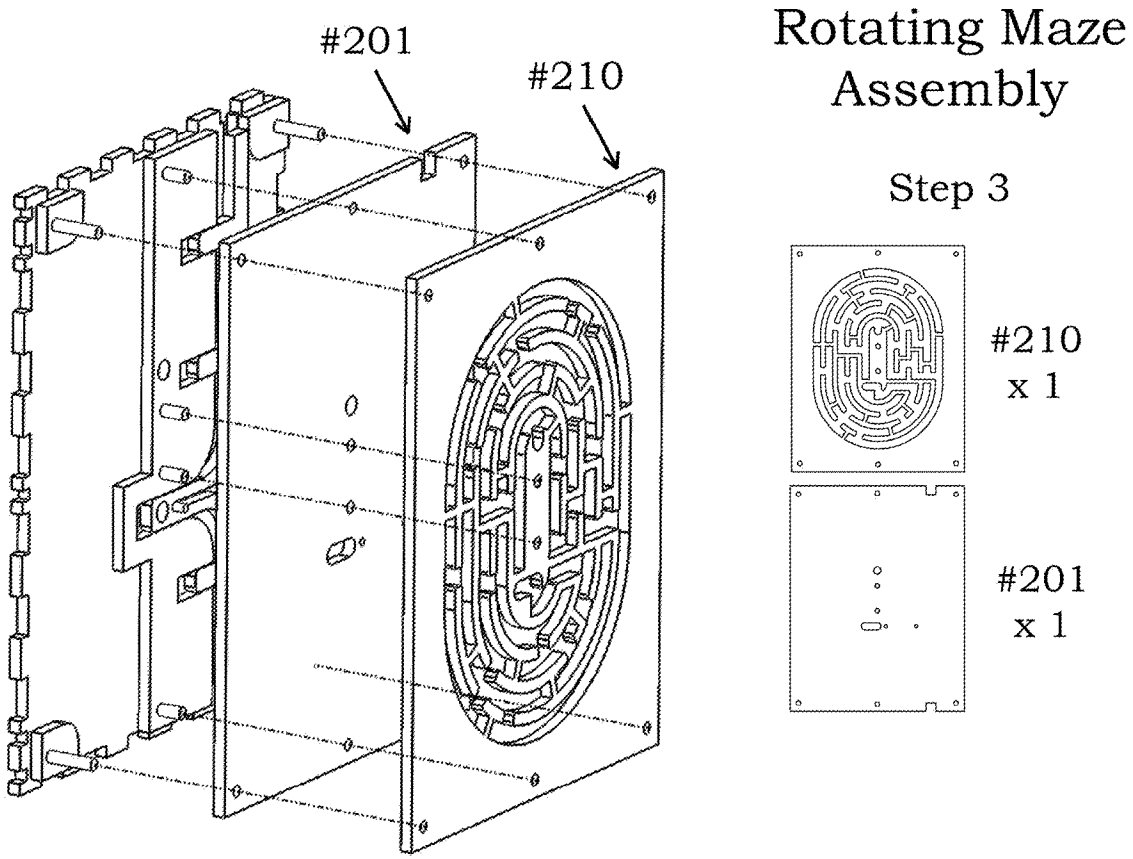
Figure 3D:
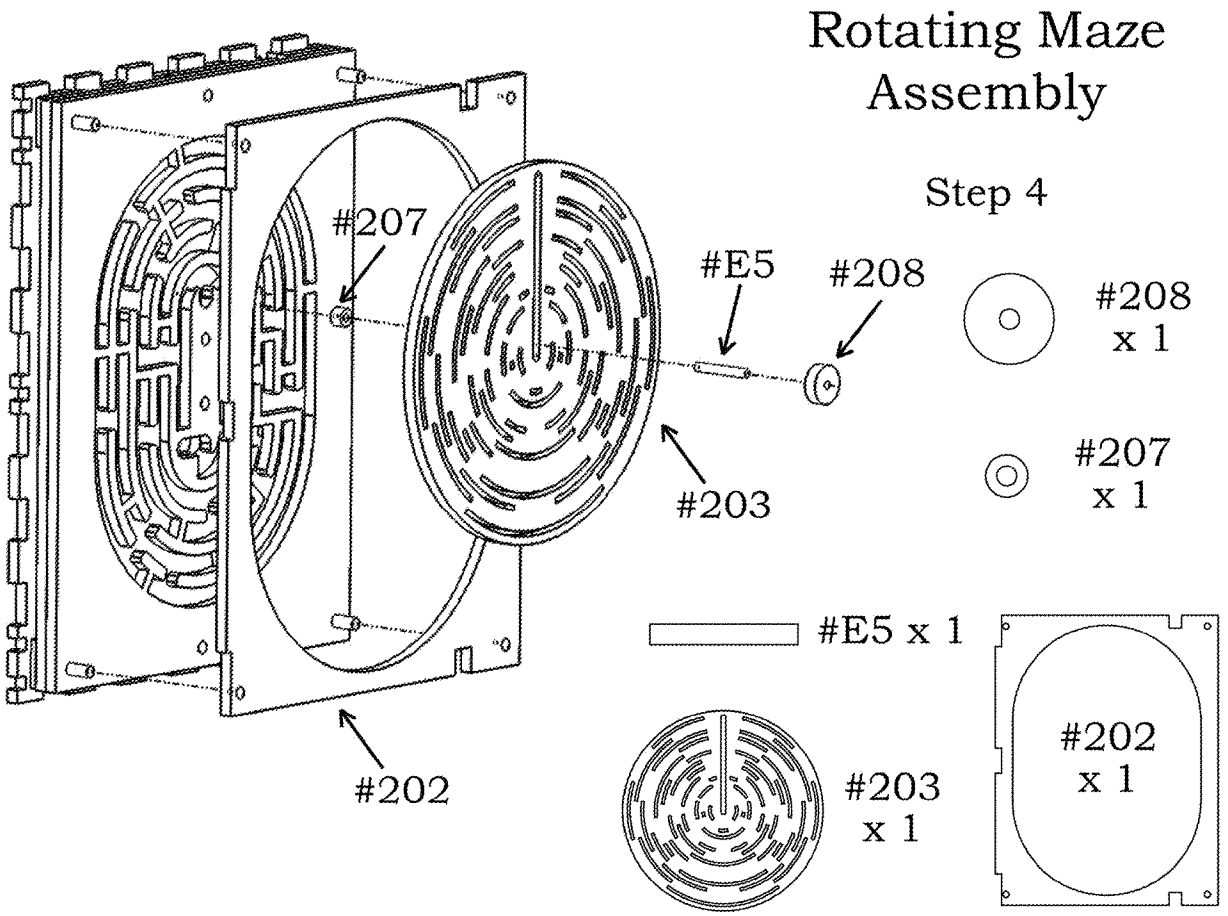
Figure 3E:
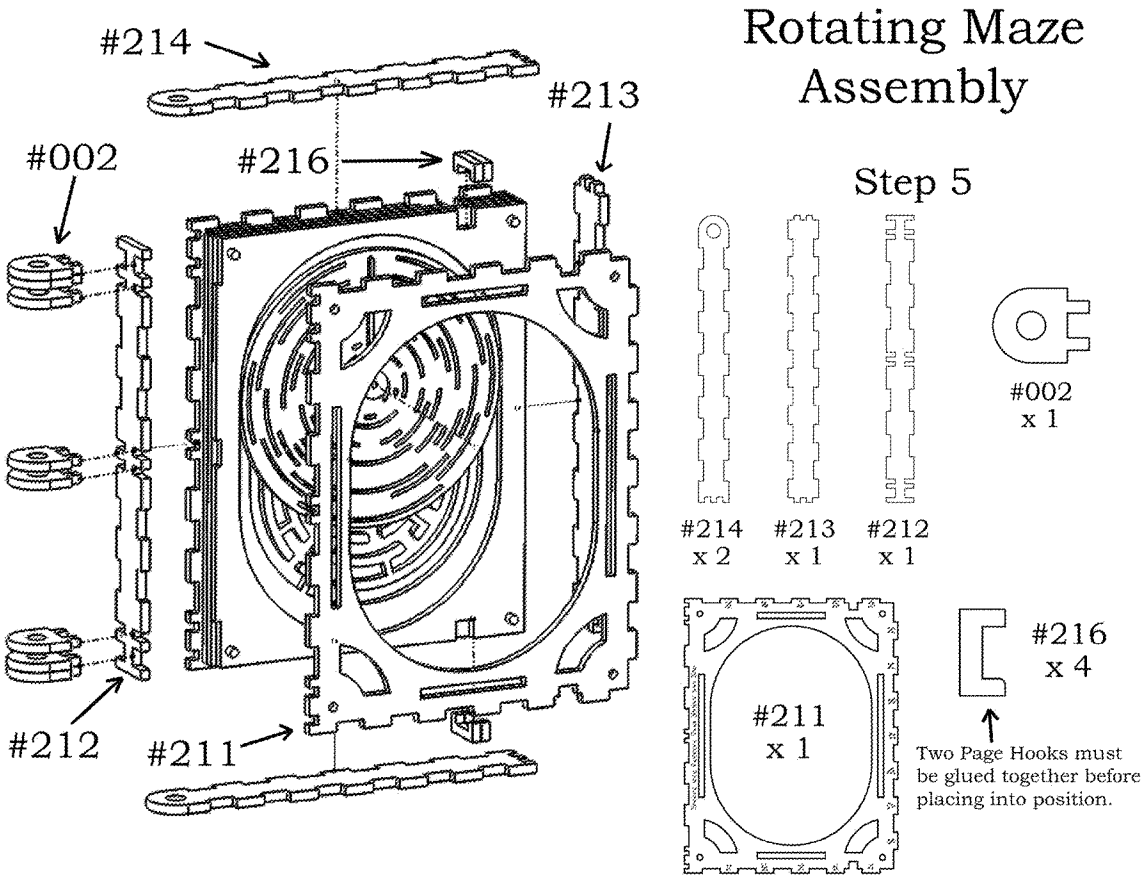

The invention is not limited by the locking mechanism shown in FIGS. 1A-1C. Those skilled in the art will appreciate that a variety of equivalent locking mechanisms can be used to implement the invention. By way of illustration and without limitation several of these alternative implementations of the locking mechanism are shown in FIGS. 1D-1F. For simplicity, these implementations are shown fully disengaged, analogous to the illustration in FIG. 1C. In FIG. 1D a latch bolt (80D) is affixed immovably to the following page (20A). Rectangular bar (50D) is moveable within the puzzle page (10D) to fit within a rectangular opening in the latch bolt (80D) to lock the pages (10D, 20A) and to withdraw from the rectangular opening in the latch bolt (80D) when the puzzle is solved, allowing the puzzle page (10D) to fully disengage from the following page (20A). Similarly, as shown in FIG. 1E, the same functionality can be implemented with a round hole in the latch bolt (81D) which is engaged by a moveable rod (60E) within the puzzle page (10E) to lock the pages (10E, 20A). The moveable rod (60E) is withdrawn from the round hole in the latch bolt (81D) when the puzzle in solved, allowing the puzzle page (10E) to fully disengage from the following page (20A).

The final illustrative example of an equivalent locking mechanism is shown in FIG. 1F. In this example the same hook portion (30A) is used in the following page (20A) as in FIGS. 1A-1C. The difference is the manner in which the moveable locking portion (70F) is engaged and disengaged. As illustrated in FIG. 1F, the moveable locking portion (70F) has concave and convex surfaces. When the pages (10F, 20A) are locked a convex surface of the locking portion (70F) is fully engaged with the hook portion (30A), maintaining the pages (10F, 20A) in a locked position. When the puzzle is solved the locking portion (70F) is twisted so that one of its concave surfaces is presented to the hook portion (30A), thereby allowing the pages (10F, 20A) to disengage.

Hinge Insert and Connectors

Figure 4A:
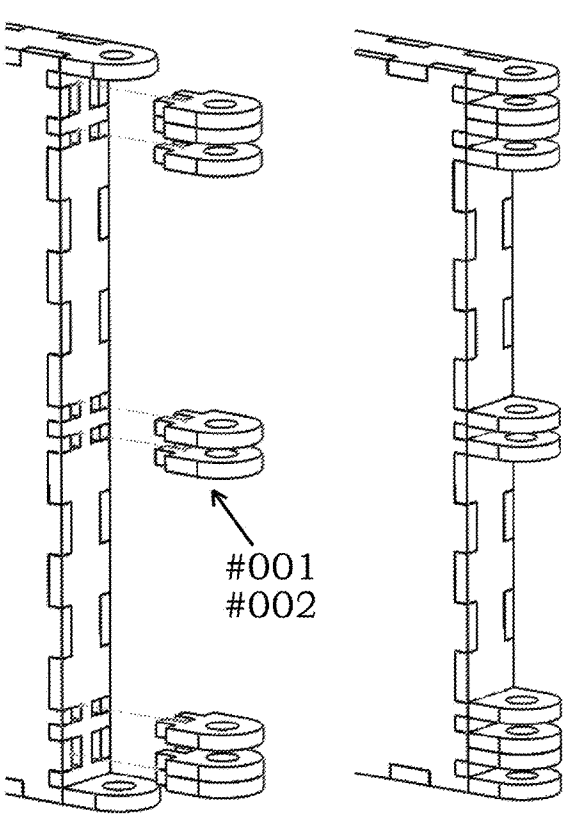
FIGS. 4A-4B are schematic diagrams showing steps (steps 1 through 2) for assembling the hinges upon which the pages of the puzzle book are turned.
Figure 4B:
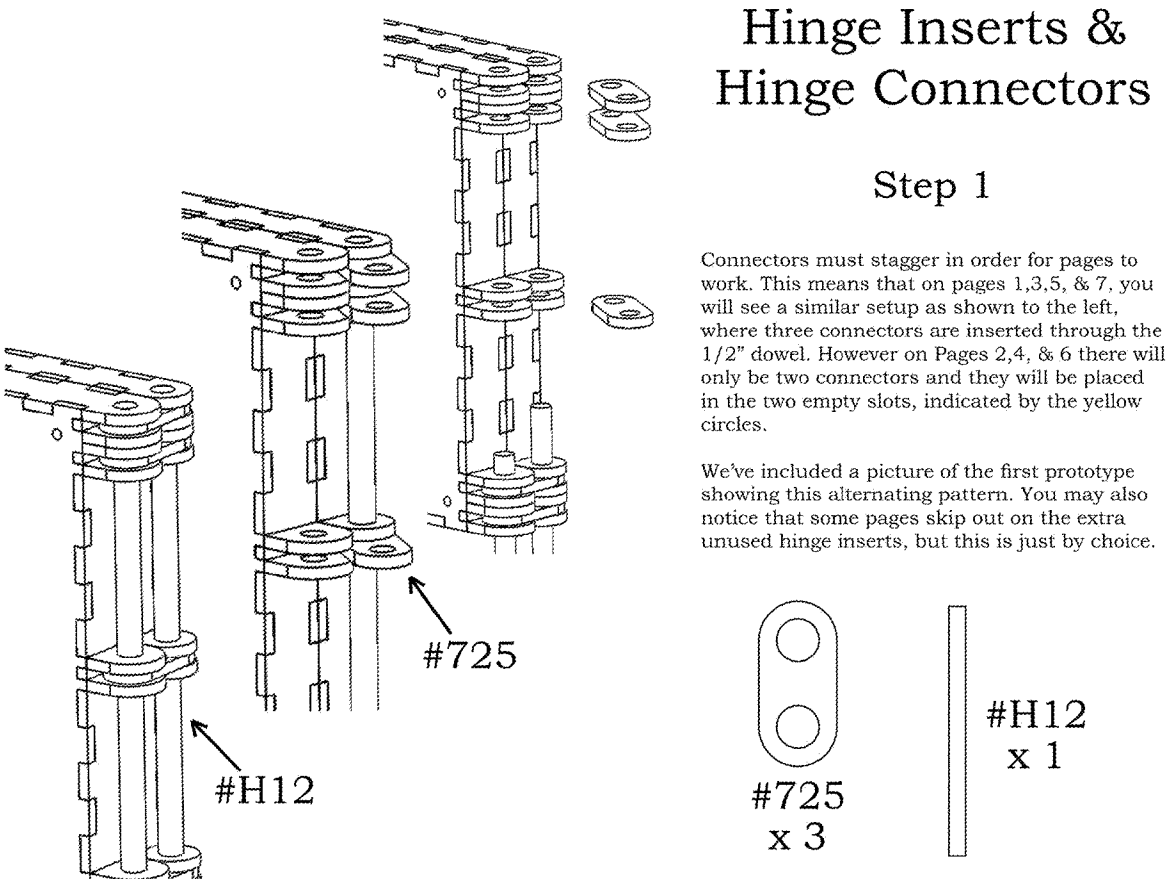

Turning now to FIGS. 4A and 4B, the assembly of the hinge inserts and connectors will be described. In order for each puzzle page of the Codex Silenda to properly function, they must all be connected along a similar plane or side, similar to the spine of a book. However conventional means of book binding were considered not sufficient enough (although they may still be used). Instead the invention provides for Hinge Connector System. The Hinge Connector System comprises three types of components of which each puzzle page has it's own set. The Hinge Inserts, of which there are two types, the Thin Hinge Insert (001) and Thick Hinge Insert (002)) are glued and inserted into the Hinge Panels (119 Mechanical Iris and 212 Rotating Maze). Next are the Hinge Connectors (725) themselves that feature two holes centered on the foci of it's elliptical slot shape. These holes are aligned with the holes of the Hinge Inserts (001, 002) of two different pages and then the Spine Dowel (H12) is inserted through all 8 Hinge Inserts (001 or 002), 3 Hinge Connectors and 2 Top/Bottom Edge Panels (120 or 214).

While the invention has been described in terms of preferred embodiments, those skilled in the art will recognize that the invention can be practiced with modification within the spirit and scope of the appended claims.

Having thus described my invention, what I claim as new and desire to secure by Letters Patent is as follows:

1. A mechanical puzzle book, comprising:

a plurality of puzzle pages, including a first puzzle page and a last puzzle page and optionally one or more intermediate puzzle pages, each puzzle page forming a plane comprised of one or more parallel planar layers and containing a puzzle to be solved by mechanical movement of puzzle pieces within said plane;

one or more locking mechanisms for locking each puzzle page to a next puzzle page;

wherein solving a puzzle disengages the locking mechanism, allowing the unlocked puzzle page to be turned, thereby exposing the next puzzle page for solution, wherein said locking mechanism further comprises a hook portion fixed to the next puzzle page and a moveable latching portion within a current puzzle page, wherein solving the puzzle causes the latching portion to move thereby disengaging from the hook portion, and wherein said hook portion fits into an opening on a back side of said current puzzle page.

2. A mechanical puzzle book as in claim 1, wherein each puzzle page includes moveable pieces within the plane of the current page which can be moved within said plane in a discoverable sequence to solve the puzzle.

3. A mechanical puzzle book as in claim 1, wherein locking mechanisms are so aligned that puzzle pages may be sequenced in any order.

* * * * *